US008674610B2

(12) United States Patent
Briggs

(10) Patent No.: US 8,674,610 B2
(45) Date of Patent: Mar. 18, 2014

(54) LIGHTING APPARATUS AND CIRCUITS FOR LIGHTING APPARATUS

(75) Inventor: Gerald Edward Briggs, Ottawa (CA)

(73) Assignee: Arkalumen Inc., Ottawa (CA)

( * ) Notice: Subject to any disclaimer, the term of this patent is extended or adjusted under 35 U.S.C. 154(b) by 411 days.

(21) Appl. No.: 12/967,024

(22) Filed: Dec. 13, 2010

(65) Prior Publication Data

US 2012/0146519 A1 Jun. 14, 2012

(51) Int. Cl.
*H05B 37/02* (2006.01)
*H05B 37/00* (2006.01)

(52) U.S. Cl.
USPC .... 315/192; 315/152; 315/185 R; 315/209 R; 315/294; 315/312

(58) Field of Classification Search
USPC ..... 315/149, 152, 185 R, 192, 193, 209 R, 315/224, 291, 294, 307, 312
See application file for complete search history.

(56) References Cited

U.S. PATENT DOCUMENTS

| | | | | |
|---|---|---|---|---|
| 5,803,579 | A * | 9/1998 | Turnbull et al. | 362/516 |
| 6,351,079 | B1 * | 2/2002 | Willis | 315/200 A |
| 2007/0278974 | A1 * | 12/2007 | Van De Ven | 315/324 |
| 2009/0322252 | A1 * | 12/2009 | Shiu et al. | 315/297 |

* cited by examiner

*Primary Examiner* — Douglas W Owens
*Assistant Examiner* — Thai Pham
(74) *Attorney, Agent, or Firm* — Sean Murray; Murray IP Consulting Inc.

(57) ABSTRACT

The present invention discloses a lighting apparatus that includes a plurality of parallel circuits and a common circuit. The parallel circuits each comprise a switching transistor and a set of LEDs, the sets of LEDs having different characteristics such as different light output wavelengths. In operation, one of the parallel circuits is selected by activating the corresponding switching transistor, thus selecting the respective LEDs to be activated. The common circuit also comprises a set of LEDs, these LEDs being activated no matter which parallel circuit is selected. In various implementations, the lighting apparatus can generate a wide spectrum of light outputs by selectively activating the plurality of parallel circuits within time slots of a duty cycle. In some cases, balancing of loads across the parallel circuits is desired to maintain the appropriate current flowing through the LEDs.

20 Claims, 8 Drawing Sheets

LIGHTING APPARATUS AND CIRCUITS FOR LIGHTING APPARATUS

FIELD OF THE INVENTION

The invention relates generally to lighting and, more particularly, to lighting apparatus and circuits for lighting apparatus.

BACKGROUND

Light Emitting Diodes (LEDs) are increasingly being adopted as general illumination lighting sources due to their high energy efficiency and long service life relative to traditional sources of light such as incandescent, fluorescent and halogen. Each generation of LEDs are providing improvements in energy efficiency and cost per lumen, thus allowing for lighting manufacturers to produce LED light fixtures at increasingly cost competitive prices. One key differentiator for LEDs over the traditional sources of light is their ability to provide high quality light with varying wavelengths based on the user's desires.

Typical LEDs today are made from a variety of inorganic semiconductor materials and can either be focused to a specific limited range of output wavelengths of light or can be made to have a broad spectrum of output wavelengths. Table 1 below summarizes a sampling of LED color options, the wavelengths for those colors and the material that they can be produced with:

TABLE 1

| Color | Wavelength (nm) | Semiconductor Material |
|---|---|---|
| Infrared | >760 | GaAs, AlGaAs |
| Red | 610-760 | AlGaAs, GaAsP, AlGaInP, GaP |
| Orange | 590-610 | GaAsP, AlGaInP, GaP |
| Yellow | 570-590 | GaAsP, AlGaInP, GaP |
| Green | 500-570 | InGaN/GaN, GaP, AlGaInP, AlGaP |
| Blue | 450-500 | ZnSe, InGaN, SiC as substrate |
| Violet | 400-450 | InGaN |
| Ultraviolet | <400 | AlN, AlGaN, AlGaInN, diamond, BN |
| White | broad spectrum | Blue or UV LED with yellow phosphor |

The above table is not meant to be a complete list but rather to illustrate the wide range in color varieties and various different semiconductor materials that have been used to-date. For example, there are new phosphor coated LEDs on the marketplace that allow for wavelength shifting of various LEDs (ex. phosphor shifted Amber LEDs).

LEDs provide opportunities to offer users a wide variety of light outputs due to the various wavelengths that can be produced. In some LED light fixtures, Red, Green, Blue (RGB) or Red, Green, Blue, Amber (RGBA) combinations are used to create white light. In some embodiments of these light fixtures, integrated LED modules are used that include LEDs of all three or four colors of light. In this case, one or more of these RGB/RGBA modules are coupled in series to generate the desired white light output. In other embodiments, a plurality of strings of single color LEDs of varying colors are used, each string of LEDs being controlled simultaneously. In some cases, these strings of LEDs may be controlled independently with separate Pulse Width Modulation (PWM) signals that dictate the length of time during a duty cycle that each string of LEDs are in operation (the "on time"). In these embodiments, a controller for the light fixture can select a variety of different light outputs by adjusting the "on time" for the various strings of LEDs.

Although the use of RGB/RGBA architectures enable for a white light output with varying colors, the light output is actually a diffused version of three or four individual wavelengths of light. These lights do not provide a full spectrum white light and normally cannot provide a high Color Rendering Index (CRI). CRI is a quantitative measure of the ability of a light source to reproduce the colors of various objects faithfully in comparison with an ideal or natural light source being a measure of light quality. Similarly, white LEDs (phosphor coated blue or UV LEDs) provide a white light output but do not provide a full spectrum and typically have a significant gap around 500 nm. Typical white LEDs also do not rate highly on CRI.

LEDs are expensive on a cost per lumen basis and can constitute a large portion of the costs for an LED light fixture. Lighting manufacturers are often working to minimize the number of LEDs within their LED light fixtures while still maintaining the desired light output in intensity and color/color temperature. When it is desired to provide the user of the light the ability to adjust the colors or color temperatures of white, a lighting manufacturer may use large numbers of LEDs creating a plurality of strings of LEDs in series.

When designing LED light fixtures for small spaces or within small traditional lighting designs (ex. MR16), the amount of LEDs used may be physically constrained by the situation. In these cases, the options for varying color or color temperature may be limited as the space to implement a plurality of strings of LEDs may not be available.

Against this background, there is a need for solutions that will enable varying light outputs within LED lighting apparatus while reducing the quantity of LEDs required.

SUMMARY OF THE INVENTION

According to a first broad aspect, the invention seeks to provide a lighting apparatus comprising a plurality of parallel circuits and a common circuit. Each of the plurality of parallel circuits comprises a switching element and one or more light emitting diodes coupled in series between a common node and one of a power rail and a ground rail. The common circuit comprises one or more light emitting diodes coupled in series between the common node and the other one of the power rail and the ground rail. In some embodiments of the present invention, the switching elements in the plurality of parallel circuits are controlled by a plurality of respective control signals, said control signals activating the plurality of switching elements at different times during a duty cycle such that significant current flows through only one of the parallel circuits at one time.

In some cases, at least one of the plurality of parallel circuits comprise a plurality of parallel sub-circuits and a common sub-circuit. Each of the parallel sub-circuits comprise a switching element and one or more light emitting diodes coupled in series between a common sub-node and the one of the power rail and the ground rail. The common sub-circuit comprises one or more light emitting diodes coupled in series between the common sub-node and the common node.

In some implementations, each of the plurality of parallel circuits may be substantially balanced such that there is a similar voltage drop across each of the parallel circuits. Each of the plurality of parallel circuits may further comprise a resistor coupled in series with the switching element and the one or more light emitting diodes, impedances of the resistors within the plurality of parallel circuits being set to substantially balance the parallel circuits such that there is a similar voltage drop across each of the parallel circuits. The one or more light emitting diodes within each of the parallel circuits may be equal in number. A voltage on the power rail may be within an acceptable voltage for voltage drops across a sum of light emitting diodes within any one of the parallel circuits and within the common circuit.

In some embodiments, the plurality of parallel circuits comprises a plurality of first parallel circuits and the common node comprises a first common node. The switching element and the one or more light emitting diodes within each of the first parallel circuits may be coupled in series between the power rail and the first common node. The lighting apparatus may further comprise a plurality of second parallel circuits, each of the second parallel circuits comprising a switching element and one or more light emitting diodes coupled in series between a second common node and the ground rail. In these embodiments, the light emitting diodes in the common circuit are coupled in series between the first and second common nodes. In some implementations, the one or more light emitting diodes within each of the first parallel circuits are equal in number and the one or more light emitting diodes within each of the second parallel circuits are equal in number. Further, a voltage on the power rail may be within an acceptable voltage for voltage drops across a sum of light emitting diodes within any one of the first parallel circuits, within the common circuit and within any one of the second parallel circuits.

In particular embodiments of the present invention, the one or more light emitting diodes within the common circuit comprise light emitting diodes that output wavelengths of light in a middle spectrum band within an overall light spectrum band visible to humans. In one case, the middle spectrum band comprises 570 nm to 590 nm. In another case, the middle spectrum band comprises 550 nm to 600 nm. In yet a further case, the middle spectrum band comprises 500 nm to 610 nm. In some cases, the one or more light emitting diodes within at least one of the parallel circuits comprise one or more light emitting diodes that output wavelengths of light outside of the middle spectrum band. In particular, the one or more light emitting diodes within at least one of the parallel circuits may comprise one or more light emitting diodes that output wavelengths of light greater than the middle spectrum band and the one or more light emitting diodes within at least one other of the parallel circuits may comprise one or more light emitting diodes that output wavelengths of light less than the middle spectrum band. In one case, the one or more light emitting diodes within at least one of the parallel circuits may comprise one or more light emitting diodes that output wavelengths of light greater than 610 nm while the one or more light emitting diodes within at least one other of the parallel circuits may comprise one or more light emitting diodes that output wavelengths of light less than 500 nm.

In other embodiments of the present invention, the one or more light emitting diodes within the common circuit may comprise one or more light emitting diodes that output wavelengths of light in a broad spectrum band. The one or more light emitting diodes within at least one of the parallel circuits may comprise one or more light emitting diodes that output wavelengths of light in a narrow spectrum band. The one or more light emitting diodes that output wavelengths of light in a broad spectrum band may comprise white light emitting diodes or may comprise integrated light emitting diodes that comprise a plurality of light emitting diodes that output different wavelengths of light. The plurality of light emitting diodes that output different wavelengths of light may comprise a red light emitting diodes, a green light emitting diode and a blue light emitting diode.

Each of the switching elements within the plurality of parallel circuits may comprise a switching transistor. In some cases, each of the plurality of parallel circuits further comprises a resistor coupled between a gate of the respective switching transistor and the one of the power rail and the ground rail.

In one embodiment, the switching transistors within each of the parallel circuits each comprise a p-channel switching transistor. In this case, the p-channel switching transistor and the one or more light emitting diodes within each of the parallel circuits are coupled in series between the power rail and the common node while the one or more light emitting diodes within the common circuit are coupled in series between the common node and the ground rail. Each of the parallel circuits may further comprise a pull-up resistor coupled between a gate of the respective p-channel switching transistor and the power rail. Further, each of the parallel circuits may further comprise a second resistor and an NPN bipolar transistor, the second resistor being coupled between the gate of the respective p-channel switching transistor and a collector of the respective NPN bipolar transistor, an emitter of the NPN bipolar transistor being coupled to the ground rail, and a base of the NPN bipolar transistor operable to receive a respective control signal. Each of the respective control signals corresponding to the plurality of parallel circuits may be operable to be at a high voltage sufficient to turn on the respective NPN bipolar transistor and create a voltage divider between the respective pull-up resistor and the respective second resistor, a resulting voltage on the gate of the respective p-channel switching transistor being sufficient to turn on the p-channel switching transistor. The respective control signals corresponding to the plurality of parallel circuits may be operable to be at the high voltage at different times during a duty cycle such that significant current flows through only one of the parallel circuits at one time. In some implementation, at least one of the plurality of parallel circuits may comprise a plurality of parallel sub-circuits and a common sub-circuit. In this case, each of the parallel sub-circuits comprise a p-channel switching transistor and one or more light emitting diodes coupled in series between a common sub-node and the power rail. The common sub-circuit comprises one or more light emitting diodes coupled in series between the common sub-node and the common node.

In another embodiment, the plurality of parallel circuits may comprise a plurality of first parallel circuits and the common node comprises a first common node. The lighting apparatus may further comprise a plurality of second parallel circuits, each of the second parallel circuits comprising an n-channel switching transistor and one or more light emitting diodes coupled in series between a second common node and the ground rail. In this case, the light emitting diodes in the common circuit are coupled in series between the first and second common nodes.

In yet another embodiment, the switching transistors within each of the parallel circuits may comprise an n-channel switching transistor. In this case, the n-channel switching transistor and the one or more light emitting diodes within each of the parallel circuits are coupled in series between the ground rail and the common node while the one or more light emitting diodes within the common circuit are coupled in series between the common node and the power rail. Each of the parallel circuits may further comprise a pull-down resistor coupled between a gate of the respective n-channel switching transistor and the ground rail. A gate of each of the respective n-channel switching transistors may be operable to receive a respective control signal. The respective control signals corresponding to the plurality of parallel circuits may be operable to be at a high voltage sufficient to turn on the respective n-channel switching transistor at different times during a duty cycle such that significant current flows through only one of the parallel circuits at one time.

In some embodiments of the present invention, the parallel circuits and the common circuit are integrated onto a single light engine module. In other embodiments, the parallel circuits and the common circuit are integrated onto a plurality of physical components.

In some embodiments of the present invention, the lighting apparatus further comprises a controller operable to control the switching elements within each of the parallel circuits. The controller may turn on the switching elements within the parallel circuits at different times during a duty cycle such that significant current flows through only one of the parallel circuits at one time. The lighting apparatus may further comprise an optics element that diffuses light output by the one or more light emitting diodes within the parallel circuits and the common circuit such that a single color of light is perceivable at an output of the lighting apparatus.

According to a second broad aspect, the invention seeks to provide a lighting apparatus comprising first, second and third circuits. The first circuit comprises a first transistor and one or more first light emitting diodes. A source of the first transistor is coupled to one of a power rail and a ground rail and a gate of the first transistor is operable to receive a first control signal to activate the first transistor. The one or more first light emitting diodes are coupled in series between a drain of the first transistor and a common node. The second circuit comprises a second transistor and one or more second light emitting diodes. The source of the second transistor is coupled to the one of the power rail and the ground rail and a gate of the second transistor is operable to receive a second control signal to activate the second transistor. The one or more second light emitting diodes are coupled in series between a drain of the second transistor and the common node. The third circuit comprises one or more third light emitting diodes coupled in series between the common node and the other one of the power rail and the ground rail.

In embodiments of the second broad aspect, the first and second control signals may activate the first and second transistors respectively at different times during a duty cycle such that significant current flows through only one of the parallel circuits at one time.

Further, in some embodiments, the first circuit further comprises a third transistor and the one or more first light emitting diodes comprises one or more fourth light emitting diodes, one or more fifth light emitting diodes and one or more sixth light emitting diodes. In this case, a source of the third transistor is coupled to the one of the power rail and the ground rail and a gate of the third transistor is operable to receive a third control signal to activate the third transistor; the one or more fourth light emitting diodes is coupled in series between the drain of the first transistor and a secondary common node; the one or more fifth light emitting diodes is coupled in series between a drain of the third transistor and the secondary common node; and the one or more sixth light emitting diodes are coupled in series between the secondary common node and the common node.

In some implementations, the first circuit may further comprise a first resistor coupled in series between the drain of the first transistor and the one or more first light emitting diodes while the second circuit may further comprise a second resistor coupled in series between the drain of the second transistor and the one or more second light emitting diodes. The impedances of the first and second resistors may be set to substantially balance a voltage drop across the first and second circuits respectively.

In some implementations, the lighting apparatus may further comprise a fourth circuit and a fifth circuit and the common node may comprise a first common node. In this implementation, the fourth circuit comprises a third transistor and one or more fourth light emitting diodes, a source of the third transistor being coupled to the other one of the power rail and the ground rail, a gate of the third transistor operable to receive a third control signal to activate the third transistor, and the one or more fourth light emitting diodes being coupled in series between a drain of the third transistor and a second common node. Further, the fifth circuit comprises a fourth transistor and one or more fifth light emitting diodes, a source of the fourth transistor being coupled to the other one of the power rail and the ground rail, a gate of the fourth transistor operable to receive a fourth control signal to activate the fourth transistor, and the one or more fifth light emitting diodes being coupled in series between a drain of the fourth transistor and the second common node. In this case, the one or more third light emitting diodes are coupled in series between the first and second common nodes.

In particular embodiments of the present invention of the second aspect, the one or more third light emitting diodes comprise light emitting diodes that output wavelengths of light in a middle spectrum band within an overall light spectrum band visible to humans. In some cases, the one or more first light emitting diodes and the one or more second light emitting diodes each comprise one or more light emitting diodes that output wavelengths of light outside of the middle spectrum band. In particular, the one or more first light emitting diodes and/or the one or more second light emitting diodes may comprise one or more light emitting diodes that output wavelengths of light greater than the middle spectrum band or may comprise one or more light emitting diodes that output wavelengths of light less than the middle spectrum band.

In other embodiments of the present invention, the one or more third light emitting diodes may comprise one or more light emitting diodes that output wavelengths of light in a broad spectrum band. At least one of the one or more first light emitting diodes and the one or more second light emitting diodes may comprise one or more light emitting diodes that output wavelengths of light in a narrow spectrum band. The one or more light emitting diodes that output wavelengths of light in a broad spectrum band may comprise white light emitting diodes or may comprise integrated light emitting diodes that comprise a plurality of light emitting diodes that output different wavelengths of light.

Within one embodiment, the first and second transistors comprise first and second p-channel transistors respectively, the source of both the first and second p-channel transistors being coupled to the power rail. In this case, the one or more third light emitting diodes are coupled in series between the common node and the ground rail. The first circuit may further comprise a first resistor coupled between the gate of the first transistor and the power rail. The first circuit may further comprise a second resistor and an NPN bipolar transistor, the second resistor being coupled between the gate of the first p-channel transistor and a collector of the NPN bipolar transistor, an emitter of the NPN bipolar transistor being coupled to the ground rail, and a base of the NPN bipolar transistor operable to receive the first control signal. The first control signal may be operable to be at a high voltage sufficient to turn on the NPN bipolar transistor and create a voltage divider between the first and second resistors, a resulting voltage on the gate of the first p-channel transistor being sufficient to turn on the first p-channel transistor. The lighting apparatus may further comprise a fourth circuit and a fifth circuit and the common node may comprise a first common node. In this case, the fourth circuit may comprise a first n-channel transistor and one or more fourth light emitting diodes, a source of the first n-channel transistor being coupled to the ground rail, a gate of the first n-channel transistor operable to receive a third control signal to activate the first n-channel transistor, and the one or more fourth light emitting diodes being coupled in series between a drain of the first n-channel transistor and a second common node. The fifth circuit may comprise a second n-channel transistor and one or more fifth light emitting diodes, a source of the second n-channel transistor being coupled to the ground rail, a gate of the second n-channel transistor operable to receive a fourth control signal to activate the second n-channel transistor, and the one or more fifth light emitting diodes being coupled in series between a drain of the second n-channel transistor and the second common node. In this implementation, the one or more third light emitting diodes are coupled in series between the first and second common nodes.

Within another embodiment, the first and second transistors comprise first and second n-channel transistors respectively, the source of both the first and second n-channel transistors being coupled to the ground rail. In this case, the one or more third light emitting diodes are coupled in series between the common node and the power rail. The first circuit may further comprise a resistor coupled between the gate of the first transistor and the ground rail.

In some implementation of the present invention of the second aspect, the first, second and third circuits are integrated onto a single light engine module. In other implementations, the first, second and third circuits are integrated onto a plurality of physical components. In yet further implementations, the first and second transistors are integrated onto a first physical component and the one or more first light emitting diodes, the one or more second light emitting diodes and the one or more third light emitting diodes are integrated on a second physical component.

According to a third broad aspect, the invention seeks to provide a lighting apparatus comprising a plurality of parallel circuits and a common circuit. Each of the plurality of parallel circuits comprises a switching element and one or more light emitting diodes coupled in series between a common node and one of a variable voltage rail and a current sense rail. The common circuit comprises one or more light emitting diodes coupled in series between the common node and the other one of the variable voltage rail and the current sense rail.

According to a fourth broad aspect, the invention seeks to provide a lighting apparatus comprising first, second and third circuits. The first circuit comprises a first transistor and one or more first light emitting diodes. A source of the first transistor is coupled to one of a variable voltage rail and a current sense rail and a gate of the first transistor is operable to receive a first control signal to activate the first transistor. The one or more first light emitting diodes are coupled in series between a drain of the first transistor and a common node. The second circuit comprises a second transistor and one or more second light emitting diodes. The source of the second transistor is coupled to the one of the variable voltage rail and the current sense rail and a gate of the second transistor is operable to receive a second control signal to activate the second transistor. The one or more second light emitting diodes are coupled in series between a drain of the second transistor and the common node. The third circuit comprises one or more third light emitting diodes coupled in series between the common node and the other one of the variable voltage rail and the current sense rail.

These and other aspects of the invention will become apparent to those of ordinary skill in the art upon review of the following description of certain embodiments of the invention in conjunction with the accompanying drawings.

BRIEF DESCRIPTION OF THE DRAWINGS

A detailed description of embodiments of the invention is provided herein below, by way of example only, with reference to the accompanying drawings, in which.

Figure 1:
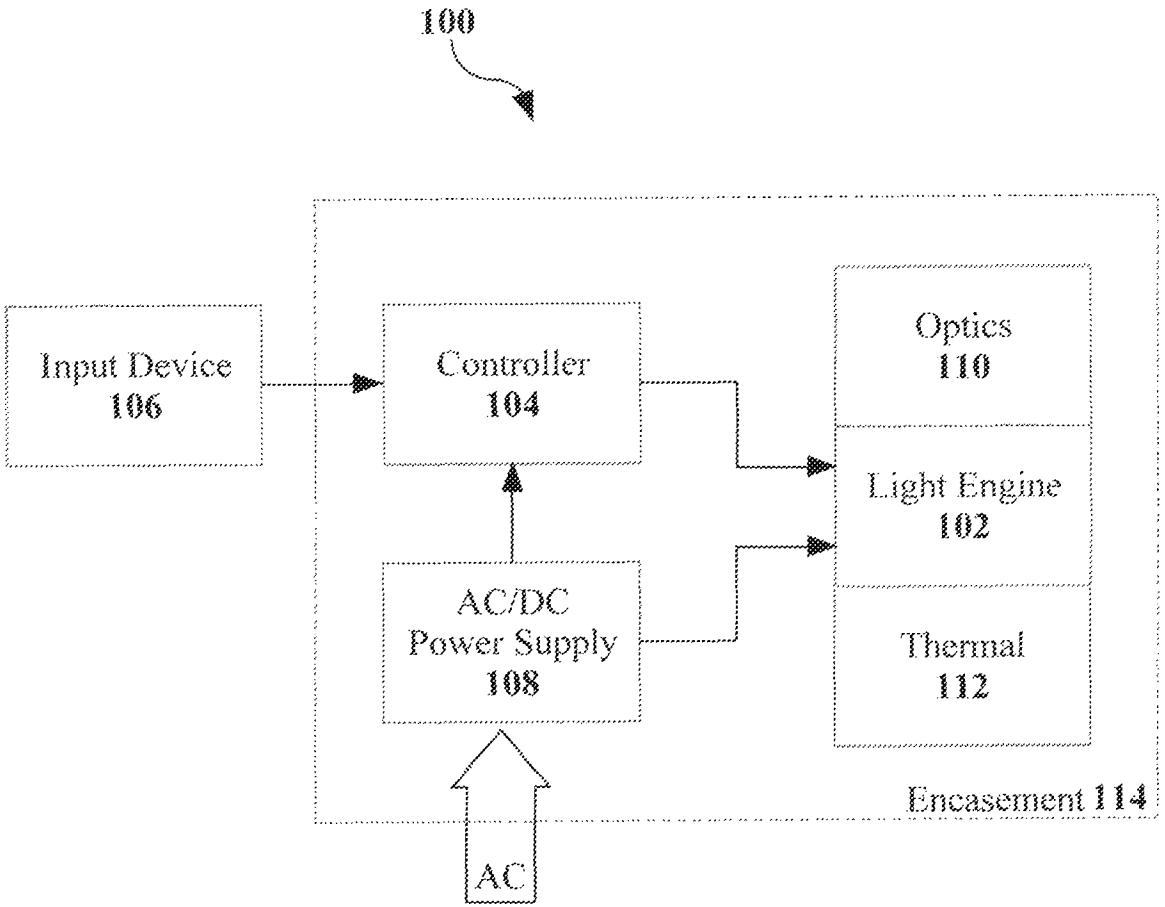
FIG. 1 is a logical block diagram of an LED lighting apparatus according to one embodiment of the present invention.

It is to be expressly understood that the description and drawings are only for the purpose of illustration of certain embodiments of the invention and are an aid for understanding. They are not intended to be a definition of the limits of the invention.

DETAILED DESCRIPTION OF EMBODIMENTS

The present invention is directed to lighting apparatus and circuits for lighting apparatus. Within embodiments described below, Light Emitting Diodes (LEDs) are implemented within light engine circuits that allow for a variant light output while utilizing a limited number of LEDs. The number of LEDs implemented within the light engine circuits according to the present invention are dependent upon the particular application but generally will have less LEDs compared to traditional light engine circuits attempting to achieve similar light output variations.

In light engine circuits according to embodiments of the present invention, a number of parallel circuits of LEDs are implemented in series with a common circuit of LEDs. Each of the parallel circuits includes a switching element such as a switching transistor. In operation, one of the parallel circuits of LEDs is activated at a time by activating the corresponding switching element and current flows through the LEDs within the active parallel circuit as well as the LEDs within the common circuit. In this manner, the LEDs within the common circuit are always on when one of the switching elements within the parallel circuits is active. The LEDs within each of the parallel circuits are only activated when their corresponding switching element is activated.

In some embodiments of the present invention, LEDs of varying output wavelengths of light are implemented within the common circuit and within the parallel circuits. For instance, in some embodiments, LEDs within the common circuit are selected to have output wavelengths of light that are always desired to be active within the color spectrum range of the lighting apparatus. For example, the common circuit could include LEDs that output light of wavelengths that are in a middle band of the light spectrum visible by humans. In this case, the range of wavelengths could be 550-600 nm, a broader range such as 500-610 nm or a narrower range such as 570-590 nm. Any other range for a middle band could be selected based on specific needs within a lighting apparatus application. The actual selection of the middle range should not be deemed to limit the scope of the present invention and, in some embodiments, the LEDs within the common circuit are not limited to a specific range of output wavelengths. In some embodiments, the LEDs within the common circuit include phosphor-based or other white LEDs that have a broad light spectrum across a plurality of wavelengths or include integrated LED modules that comprise a plurality of LEDs of varying wavelengths. Examples of integrated LED modules are RGB and RGBA LED modules that integrate LEDs with red/green/blue outputs and red/green/blue/amber outputs respectively.

Within the parallel circuits, the LEDs may enable a wide variety of light output wavelengths. In some cases, the LEDs within one of the parallel circuits may output light wavelengths that are also in a middle band of the light spectrum visible by humans. In other cases, the LEDs within one of the parallel circuits may output light wavelengths that are focused high or low on the light spectrum. For example, in one parallel circuit, LEDs may have light output wavelengths greater than 610 nm (i.e. red) while another parallel circuit may have LEDs with light output wavelengths less than 500 nm (i.e. blue or violet). In embodiments of the present invention as will be described in detail below, a controller can manage the particular output spectrum from the lighting apparatus by controlling the lengths of time that each parallel circuit is activated.

FIG. 1 is a logical block diagram of an LED lighting apparatus 100 according to one embodiment of the present invention. As depicted, the LED lighting apparatus 100 comprises a number of distinct components that together enable the lighting apparatus 100 to output light with a particular light spectrum. The LED lighting apparatus comprises a light engine 102 which comprises a circuit with LEDs that emit light when activated; a controller 104 that outputs control signals to the light engine 102 to control the LEDs; an input device 106 used by a user of the lighting apparatus 100 to select aspects of the light output such as the intensity, color and/or color temperature; and an AC/DC power supply 108 that receives AC power from the power grid (not shown) and provides DC power to the controller 104 and the light engine 102. As shown in FIG. 1, the lighting apparatus 100 further comprises an optics element 110 that diffuses the light output from the LEDs and a thermal element 112 that removes heat generated by the LEDs in order to enable them to operate at an acceptable temperature. In this particular embodiment, the lighting apparatus 100 further comprises and encasement 114 that provides protective structure and artistic design to the lighting apparatus 100. In this case, the encasement 114 encases the light engine 102, the controller 104, the AC/DC power supply, the optics element 110 and the thermal element 112.

The light engine 102 according to various embodiments of the present invention will be described in detail below with reference to FIGS. 2A, 2B, 3, 4A, 4B, 5A and 5B. It should be understood that although depicted as a single component in FIG. 1, the light engine 102 may comprise a plurality of components. For example, the LEDs may be physically separated from non-LED elements. Further, all or some of the elements within the light engine 102 may be integrated within another component such as the controller 104, the thermal element 112 or even the encasement 114 or optics element 110.

The controller 104 in FIG. 1 manages the activation of the LEDs within the light engine 102 as will be described in detail herein below and, therefore, controls the output light spectrum that is generated by the lighting apparatus 100. In the architecture depicted in FIG. 1, the controller 104 receives a constant voltage rail or a constant current source and a reference ground from the AC/DC power supply 108 and receives user input signals from the input device 106. The controller 104 interprets the user input signals and may rely on information stored within a local memory (not shown) and internal software or firmware to generate the control signals for the light engine 102. Each of the control signals, according to some embodiments of the present invention, comprises a pulse signal that may be in an active high state for a set time within a duty cycle.

As one skilled in the art would understand, the controller 104 can take a number of different forms including a microcontroller programmed with software, firmware, an ASIC, an FPGA, a microprocessor, logical hardware components or other components that can generate digital signals. In one particular embodiment, the controller comprises a microprocessor from Microchip Technologies Inc. of Chandler, Ariz., USA.

The input device 106 may comprise a dimmer (ex. a triac dimmer, a 0-10V Lutron dimmer), an infrared remote control, a computer or any other device that can allow a user to make selections concerning aspects of the lighting apparatus 100. The aspects selected may comprise any one or more of the intensity, the color, the color temperature, tint, etc. In some cases, the input device 106 may comprise sensor devices such as an ambient light sensor, a motion sensor and/or an occupancy sensor. In these cases, the sensors may provide input signals to the controller 104 that affect the control signals that the controller 104 transmits to the light engine 102. In some embodiments, the input device 106 may be integrated with another component such as the controller 104 or the encasement 102. In other cases, the lighting apparatus 100 may not have an input device 106. For instance, in one embodiment, variations in the aspects of the light output may be controlled by the controller 104 without external inputs using pre-programmed code. The pre-programmed code could be enabled based on an internal clock, a vibration detection sensor, an internal ambient light sensor, an internal motion sensor, an internal occupancy sensor, or another component that may trigger a change in an aspect of the lighting apparatus 100. Further, the pre-programmed code could be set at the factory to calibrate the color temperature/color of the lighting apparatus. Yet further, the lighting apparatus 100 in some embodiments comprises a color sense component and the pre-programmed code can correct for variations in the color temperature or color, for example variations may occur over time as LEDs may decrease in intensity at different rates.

The AC/DC power supply 108 may comprise a large number of different power supply configurations depending upon the particular application. For instance, the AC/DC power supply 108 should be selected to match the power needs of the light engine 102 and the controller 104 and particularly to the LEDs within the light engine 102 which will utilize the majority of the power. In one example, a 24V/20W power supply may be used in a light engine configuration that activates 7 LEDs in series at a time, each LED having a voltage drop of approximately 3.4V in this example.

One skilled in the art will understand that the optics element 110 and the thermal element 112 can be implemented in many different manners depending on the specific technical requirements of the lighting apparatus 100. The optics element 110, according to some embodiments of the present invention, diffuse the light output from the LEDs such that a single color of light is perceivable at an output of the lighting apparatus 100. In one specific example, the optics element 110 comprises a frosted acrylic plate. The thermal element 112 may comprise a heat sink, a heat conductive plate or film, heat conductive fins, one or more heat pipes, a fan, a heat removal diaphragm or other elements that can enable flow of heat away from the LEDs.

It should be understood that the lighting apparatus 100 of FIG. 1 is only a sample lighting architecture that could be used with the present invention and should not be used to limit the scope of the present invention. Large numbers of alternative lighting architectures are understood by one skilled in the art. For instance, the controller 104 could be integrated with any one or more of the light engine 102, the input device 106 and the AC/DC power supply 108. Further, in some lighting architectures, one or more of the components within the lighting apparatus 100 may be removed. For instance, in some lighting architectures the thermal element 112 may be removed as passive cooling could be sufficient to remove heat generated by the LEDs or the encasement 114 could act as a thermal element itself.

Figure 2A:
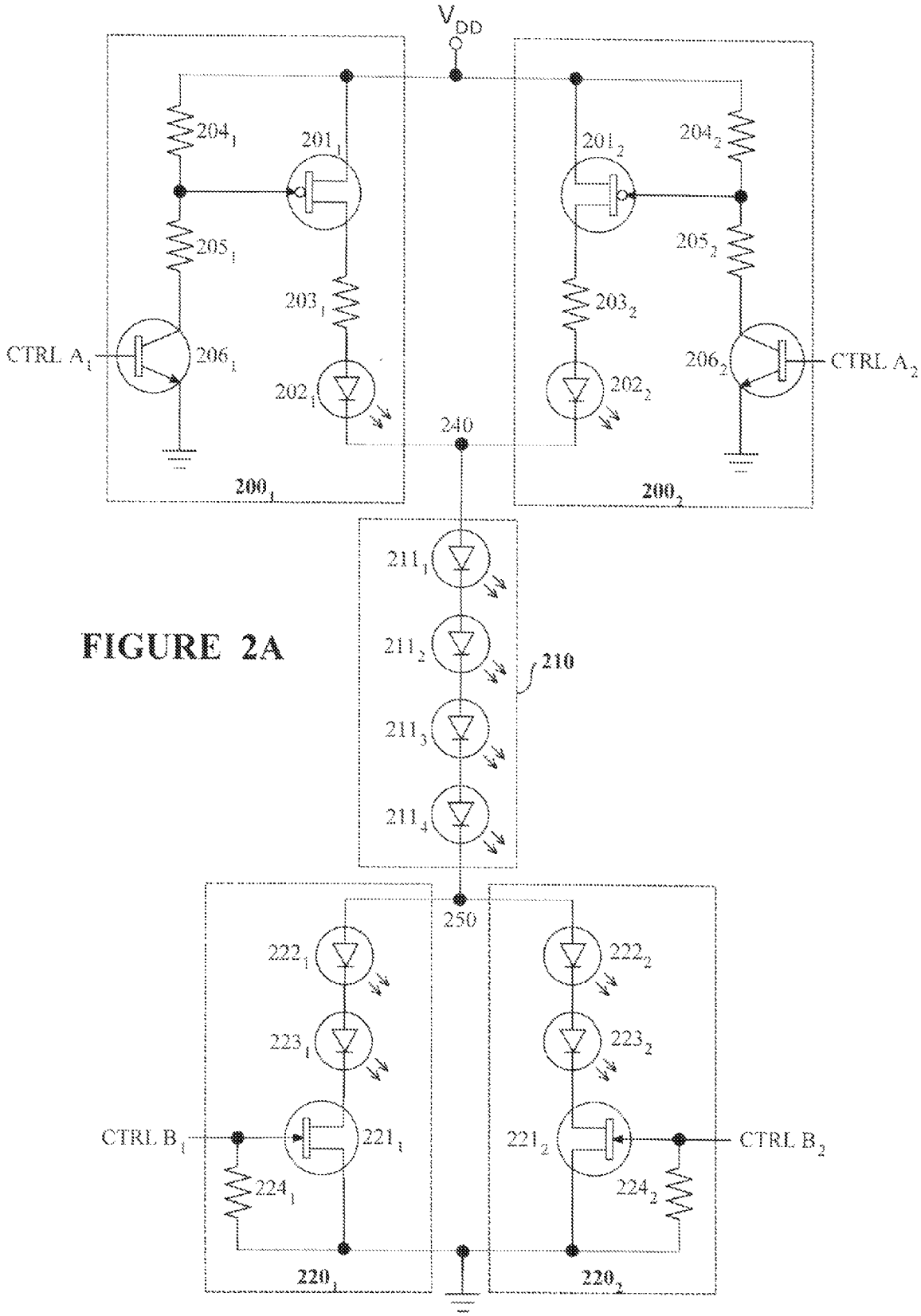
FIGS. 2A and 2B are electrical circuit diagrams of light engines according to first and second embodiments of the present invention.

FIG. 2A is an electrical circuit diagram of a light engine according to a first embodiment of the present invention. This embodiment is a specific example in which ten LEDs are used to create four potential output light spectrum boundary points by activating one of four potential current paths. In operation as will be described below, only seven of the LEDs are activated at any one time. Within FIG. 2A, the light engine 102 comprises first and second parallel circuits $\mathbf{200}_1$,$\mathbf{200}_2$, coupled in parallel between a power rail ($V_{DD}$) and a first common node 240; a common circuit 210 coupled between the first common node 240 and a second common node 250; and third and fourth parallel circuits $\mathbf{220}_1$,$\mathbf{220}_2$ coupled in parallel between the second common node and a ground rail.

Each of the first and second parallel circuits $\mathbf{200}_1$, $\mathbf{200}_2$ comprises a corresponding p-channel switching transistor $\mathbf{201}_1$,$\mathbf{201}_2$ coupled in series with a resistor $\mathbf{203}_1$,$\mathbf{203}_2$ and an LED $\mathbf{202}_1$,$\mathbf{202}_2$ respectively. The sources of the p-channel transistors $\mathbf{201}_1$,$\mathbf{201}_2$ are both coupled to the power rail ($V_{DD}$) while the drains of the p-channel transistors $\mathbf{201}_1$,$\mathbf{201}_2$ are coupled to one end of the respective resistors $\mathbf{203}_1$,$\mathbf{203}_2$. The LEDs $\mathbf{202}_1$,$\mathbf{202}_2$ are coupled between the other end of the respective resistors $\mathbf{203}_1$,$\mathbf{203}_2$ and the common node 240. As shown in FIG. 2A, the first and second parallel circuits $\mathbf{200}_1$, $\mathbf{200}_2$ each further comprise a pull-up resistor $\mathbf{204}_1$,$\mathbf{204}_2$ respectively coupled between the gate of the corresponding p-channel transistor $\mathbf{201}_1$,$\mathbf{201}_2$ and the power rail ($V_{DD}$); and a pull-down resistor $\mathbf{205}_1$,$\mathbf{205}_2$ respectively coupled in series with a corresponding NPN bipolar transistor $\mathbf{206}_1$,$\mathbf{206}_2$. The pull-down resistors $\mathbf{205}_1$,$\mathbf{205}_2$ are coupled between the gate of the respective p-channel transistors $\mathbf{201}_1$,$\mathbf{201}_2$ and the collector of the respective NPN bipolar transistor $\mathbf{206}_1$,$\mathbf{206}_2$ while the emitters of the NPN bipolar transistors $\mathbf{206}_1$,$\mathbf{206}_2$ are coupled to the ground rail. The base of each of the NPN bipolar transistors $\mathbf{206}_1$,$\mathbf{206}_2$ are coupled to a corresponding control signal CTRL $A_1$, CTRL $A_2$.

Within the first and second parallel circuits $\mathbf{200}_1$,$\mathbf{200}_2$, the p-channel transistors $\mathbf{201}_1$, $\mathbf{201}_2$ act as switching elements, coupling their respective drain and source together when activated and creating an open circuit between their drain and source when not activated. In one particular example implementation, when a voltage on the source becomes greater than or equal to 3V compared to a voltage on the gate, the p-channel transistor $\mathbf{201}_1$,$\mathbf{201}_2$ is on while if the difference in voltage is less than 3V, the p-channel transistor $\mathbf{201}_1$,$\mathbf{201}_2$ is off. Other voltage differences may be used in other applications depending upon the p-channel transistors used. Further, it should be understood that other switching elements that allow for similar on/off properties could be used in place of the p-channel switching transistors $\mathbf{201}_1$,$\mathbf{201}_2$.

The resistors $\mathbf{203}_1$,$\mathbf{203}_2$ are implemented to aid in regulating the high frequency ringing impulses of current flowing through the circuit and provide some isolation protection to the LEDs $\mathbf{203}_1$,$\mathbf{203}_2$ from the power rail ($V_{DD}$). The resistors $\mathbf{203}_1$,$\mathbf{203}_2$ in some embodiments may be the same impedance value while, in other embodiments, the impedance for the resistor $\mathbf{203}_1$ may be different than the impedance of the resistor $\mathbf{203}_2$. A difference in impedance between the resistors $\mathbf{203}_1$,$\mathbf{203}_2$ may be desired if there is a difference between the voltage drop across LED $\mathbf{202}_1$ and the voltage drop across LED $\mathbf{202}_2$ at equal currents. In this case, a differential in the impedances of the resistors $\mathbf{203}_1$,$\mathbf{203}_2$ may be used to mitigate this issue and increase the balance between the first and second parallel circuits $\mathbf{200}_1$,$\mathbf{200}_2$. A difference in impedance between the resistors $\mathbf{203}_1$,$\mathbf{203}_2$ may also be desired if slightly different current levels are desired for different potential current paths within the circuit, for instance if it is desired to make one of the LEDs $\mathbf{202}_1$, $\mathbf{202}_2$ to output higher lumens in a particular application. In one particular example implementation, the resistors $\mathbf{203}_1$,$\mathbf{203}_2$ may both be 0.5Ω. In another implementation, the resistor $\mathbf{203}_1$ may be 0.5Ω while the resistor $\mathbf{203}_2$ may be 0.25Ω. One skilled in the art would understand that other values of impedance could be used depending on the application. In alternative embodiments, the resistors $\mathbf{203}_1$,$\mathbf{203}_2$ are not used and the p-channel transistors $\mathbf{201}_1$,$\mathbf{201}_2$ are directly coupled to the respective LEDs $\mathbf{202}_1$,$\mathbf{202}_2$.

The pull-up resistors $\mathbf{204}_1$,$\mathbf{204}_2$ within the first and second parallel circuits $\mathbf{200}_1$,$\mathbf{200}_2$ respectively are used to ensure that the respective p-channel transistors $\mathbf{201}_1$, $\mathbf{201}_2$ are off if no specific voltage is applied at their gate. If the corresponding NPN bipolar transistor $\mathbf{206}_1$,$\mathbf{206}_2$ is off, then the connection of the gate of the p-channel transistors $\mathbf{201}_1$,$\mathbf{201}_2$ to the power rail ($V_{DD}$) via the respective pull-up resistors $\mathbf{204}_1$, $\mathbf{204}_2$ will make the voltage at the gate substantially similar to the voltage on the power rail ($V_{DD}$). If the corresponding NPN bipolar transistor $\mathbf{206}_1$,$\mathbf{206}_2$ is on, the respective pull-up resistors $\mathbf{204}_1$,$\mathbf{204}_2$ and pull-down resistors $\mathbf{205}_1$,$\mathbf{205}_2$ become a voltage divider that applies a specified voltage to the gate of the p-channel transistor $\mathbf{201}_1$,$\mathbf{201}_2$. In one particular example implementation, the power rail ($V_{DD}$) may be 24V while the pull-up resistors $\mathbf{204}_1$,$\mathbf{204}_2$ are 5 kΩ and the pull-down resistors $\mathbf{205}_1$,$\mathbf{205}_2$ are 20 kΩ. In this particular example, if one of the NPN bipolar transistors $\mathbf{206}_1$,$\mathbf{206}_2$ are turned on, the voltage divider generates a voltage of approximately 20 kΩ/(20 kΩ+5 kΩ)×24V=19.2V at the gate of the corresponding p-channel transistor $\mathbf{201}_1$,$\mathbf{201}_2$ and hence turns the corresponding p-channel transistor $\mathbf{201}_1$,$\mathbf{201}_2$ on safely at the desired switch equivalent on impedance. The voltage divider configuration depicted in FIG. 1 for controlling the on/off state of the p-channel transistors $\mathbf{201}_1$,$\mathbf{201}_2$ is only one potential implementation and should not limit the scope of the present invention. Other techniques for applying appropriate voltages to the gate of the p-channel transistors or to a triggering point of an alternative switching element may be used. The particular implementation within FIG. 2A has the advantage of allowing the control signals CTRL $A_1$, CTRL $A_2$ to trigger the on/off state of the p-channel transistors $\mathbf{201}_1$,$\mathbf{201}_2$ through the voltage divider while remaining at a relatively low voltage that can be output from a microcontroller (ex. 0-3V).

The common circuit 210, within the embodiment depicted in FIG. 2A, comprises four LEDs $\mathbf{211}_1$,$\mathbf{211}_2$,$\mathbf{211}_3$,$\mathbf{211}_4$ coupled in series between the first and second common nodes. In this particular embodiment, the four LEDs $\mathbf{211}_1$,$\mathbf{211}_2$, $211_3$,$211_4$ are common to all four potential current paths and therefore will be activated whenever any of the four potential current paths are activated as will be described below.

Each of the third and fourth parallel circuits $220_1$, $220_2$ comprises a corresponding n-channel switching transistor $221_1$,$221_2$ coupled in series with respective first LEDs $222_1$, $222_2$ and second LEDs $223_1$,$223_2$. The sources of the n-channel transistors $221_1$,$221_2$ are both coupled to the ground rail and the first LEDs $222_1$,$222_2$ and second LEDs, $223_1$,$223_2$ are coupled in series between the drain of the corresponding n-channel transistor $221_1$,$221_2$ and the second common node. The third and fourth parallel circuits $220_1$,$220_2$ each further comprise a pull-down resistor $224_1$,$224_2$ respectively coupled between the gate of the corresponding n-channel transistor $221_1$,$221_2$ and the ground rail. The gate of each of the n-channel transistors $221_1$,$221_2$ are further coupled to a corresponding control signal CTRL $B_1$, CTRL $B_2$.

Within the third and fourth parallel circuits $220_1$,$220_2$, the n-channel transistors $221_1$, $221_2$ act as switching elements, coupling their respective drain and source together when activated and creating an open circuit between their drain and source when not activated. In one particular example implementation, when a voltage on the gate becomes greater than or equal to 3V compared to a voltage on the source, the n-channel transistor $221_1$,$221_2$ is on while if the difference in voltage is less than 3V, the n-channel transistor $221_1$,$221_2$ is off. Other voltage differences may be used in other applications depending upon the n-channel transistors used. Further, it should be understood that other switching elements that allow for similar on/off properties could be used in place of the n-channel switching transistors $221_1$,$221_2$.

The pull-down resistors $224_1$,$224_2$ within the third and fourth parallel circuits $200_1$, $200_2$ respectively are used to ensure that the respective n-channel transistors $221_1$, $221_2$ are off if no specific voltage is applied at their gate. If the respective control signal CTRL $B_1$, CTRL $B_2$ does not apply a voltage to the gate of the corresponding n-channel transistors $221_1$,$221_2$, then the connection of the gate of the n-channel transistors $221_1$,$221_2$ to the ground rail via the respective pull-down resistors $224_1$, $224_2$ will make the voltage at the gate substantially similar to the voltage on the ground rail. In one particular example implementation, the pull-down resistors $224_1$,$224_2$ are 10 kΩ, though one skilled in the art would understand that alternative values for the pull-down resistors $224_1$,$224_2$ could be used. In some cases, the pull-down resistors $224_1$,$224_2$ could be removed; for example, if the controller that generates the control signals CTRL $B_1$, CTRL $B_2$ has built in resistors coupled to ground.

In operation, the circuit of FIG. 2A has four potential current paths based upon which switching transistors $201_1$, $202_2$,$221_1$,$221_2$ are turned on. At any particular instant in time when the circuit is activated, only one of the p-channel transistors $201_1$,$201_2$ is turned on and only one of the n-channel transistors $221_1$,$221_2$ is turned on. Therefore, at any one instant in time when the circuit is activated, current flows through one of the first and second parallel circuits $200_1$,$200_2$, the common circuit 210 and one of the third and fourth parallel circuits $220_1$,$220_2$. In this case, the LEDs $211_1$,$211_2$, $211_3$,$211_4$ within the common circuit 210 are activated whenever one of the four potential current paths is activated while the LEDs $202_1$,$202_2$,$222_1$,$222_2$$223_1$,$223_2$ within the parallel circuits $200_1$,$200_2$,$220_1$,$220_2$ are only selectively activated. In particular, only one of the LEDs $202_1$,$202_2$ within the first and second parallel circuits $200_1$,$200_2$ respectively are activated at any one instant in time and only one of the sets of LEDs within the third and fourth parallel circuits $220_1$,$220_2$ are activated at any one instant in time (LEDs $222_1$,$223_1$ of the third parallel circuit $220_1$ or LEDs $222_2$,$223_2$ of the fourth parallel circuit $220_2$).

As discussed above, the control signals CTRL $A_1$, CTRL $A_2$, CTRL $B_1$ and CTRL $B_2$ control which of the switching transistors $201_1$,$201_2$,$221_1$,$221_2$ are turned on at any instant in time. Depending on which of the control signals CTRL $A_1$ and CTRL $A_2$ are in a high state (for example 3V in some implementations), either p-channel transistor $201_1$ or p-channel transistor $201_2$ will be "on". Similarly, depending on which of the control signals CTRL $B_1$ and CTRL $B_2$ are in a high state, either n-channel transistor $221_1$ or n-channel transistor $221_2$ will be "on". Hence, there are four operational states with varying current paths that can be dynamically created using the circuit of FIG. 2A. As well, there is an inactive operational state in which all of the LEDs within the circuit are inactive when both of the p-channel transistors $201_1$,$201_2$ are off and/or both of the n-channel transistors $221_1$,$221_2$ are off. The inactive operational state may be used to reduce the intensity of the light in some embodiments. The potential operational states for the circuit of FIG. 2A are summarized in Table 2 below.

TABLE 2

| | Operational States | | | | |
|---|---|---|---|---|---|
| | 1 | 2 | 3 | 4 | Inactive |
| Transistor $201_1$ | ON | OFF | ON | OFF | OFF |
| Transistor $201_2$ | OFF | ON | OFF | ON | OFF |
| Transistor $221_1$ | ON | ON | OFF | OFF | OFF |
| Transistor $221_2$ | OFF | OFF | ON | ON | OFF |
| LED $202_1$ | ON | OFF | ON | OFF | OFF |
| LED $202_2$ | OFF | ON | OFF | ON | OFF |
| LED $211_1$ | ON | ON | ON | ON | OFF |
| LED $211_2$ | ON | ON | ON | ON | OFF |
| LED $211_3$ | ON | ON | ON | ON | OFF |
| LED $211_4$ | ON | ON | ON | ON | OFF |
| LED $222_1$ | ON | ON | OFF | OFF | OFF |
| LED $223_1$ | ON | ON | OFF | OFF | OFF |
| LED $222_2$ | OFF | OFF | ON | ON | OFF |
| LED $223_2$ | OFF | OFF | ON | ON | OFF |
| Total LEDs ON | 7 | 7 | 7 | 7 | 0 |

As shown in the above Table, each of the operational states for the circuit have a total of seven LEDs active but a different set of seven LEDs. As the various LEDs within the circuit may have different characteristics, the light output from the lighting apparatus may have a different light spectrum and/or light intensity depending upon which operational state the circuit is operating in.

In one particular example, the LEDs within the circuit of FIG. 2A may each be LEDs directed to a specific light spectrum band. In one sample case, LED $202_1$ comprises a red LED; LED $202_2$ comprises a royal blue LED; LEDs $211_1$, $211_2$, $211_3$, $211_4$ comprise two phosphor converted amber LEDs, an orange LED and a high wavelength green LED; LEDs $222_1$, $223_1$ comprise a red LED and an orange LED; and LEDs $222_2$,$223_2$ comprise a high wavelength blue LED and a low wavelength green LED. In this configuration, each of the four operational states produces a light output with a light spectrum of different wavelengths.

Figure 3:
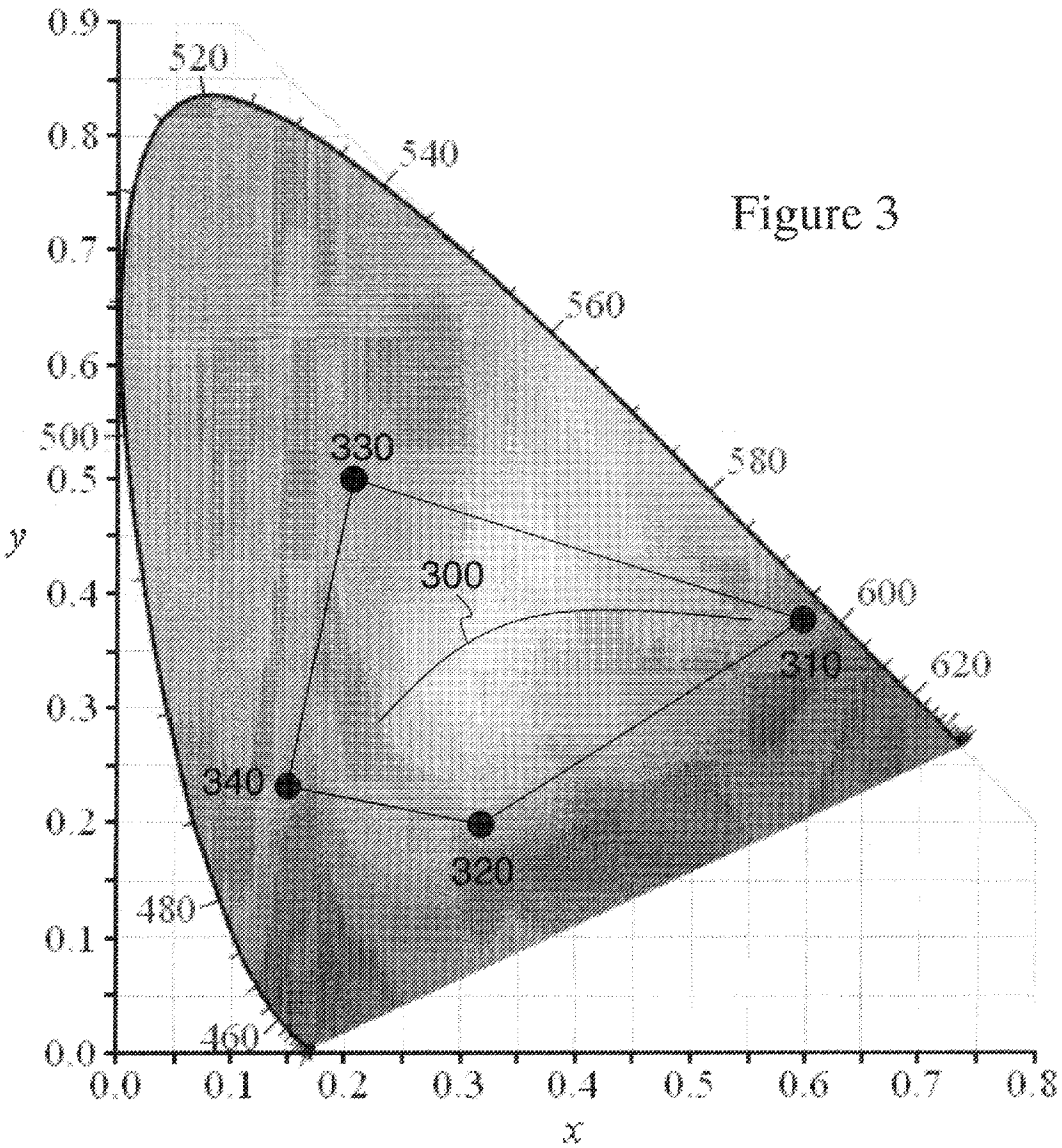
FIG. 3 is a graphical depiction of the CIE (International Commission on Illumination) 1931 chromaticity diagram overlaid with example points that could be achieved using the LED light engine of FIG. 2A.

FIG. 3 is a graphical depiction of the well-known CIE (International Commission on Illumination) 1931 chromaticity diagram overlaid with example points that could be achieved using the circuit of FIG. 2A. A chromaticity is a color projected into a two-dimensional space that ignores brightness. For example, the standard CIE XYZ color space projects directly to the corresponding chromaticity space specified by the two chromaticity coordinates known as x and y, making the familiar chromaticity diagram shown in FIG. 3. The Planckian locus, the path that the color of a black body takes as the blackbody temperature changes, is shown roughly in FIG. 3 as curve 300. Further within FIG. 3, nodes 310, 320, 330, 340 within the chromaticity diagram correspond to color spectrum outputs that are possible using the four boundary operational states of the circuit in FIG. 2A; node 310 for operational state 1 within Table 2, node 320 for operational state 2 within Table 2, node 330 for operational state 3 within Table 2 and node 340 for operational state 4 within Table 2. In this case, the four nodes 310,320,330,340 form a four-sided polygon within the chromaticity diagram which includes a large portion of the Planckian locus curve 300.

Each of the operational states of the circuit of FIG. 2A can be activated for a period of time within a duty cycle. Therefore, within a single duty cycle, the light output may vary between the four particular light spectrums associated with the four operational states, as well as the inactive operational state. In embodiments of the present invention, the duty cycle of the lighting apparatus is sufficiently short to avoid detection by a human eye that the light output is dynamically changing. For example, in one particular implementation, the duty cycle is one millisecond.

Within each duty cycle, the control signals CTRL $A_1$, CTRL $A_2$, CTRL $B_1$, CTRL $B_2$ can be transmitted by a controller such as the controller 104 of FIG. 1 to the circuit of FIG. 2A in order to activate one or more of the operational states, each for a limited time segment of the duty cycle. In an example implementation, the time segments of the duty cycle may be divided into time slots (ex. 256 time slots) and each operational state may be assigned a particular number of time slots to be active. Although, using this technique, the lighting apparatus will have a light output with a dynamically changing wavelength spectrum, the mix of the light outputs over the duty cycle or over a plurality of duty cycles can generate a uniform color of light that will be seen by the human eye. An appropriate optics such as the optics element 110 can further enhance the diffusion of the various light outputs from the LEDs.

By modulating between the operational states of the circuit of FIG. 2A within a duty cycle, light outputs can be achieved with a large variety of light spectrums. In fact, referring back to FIG. 3 and using the four nodes 310, 320, 330, 340 as the light output chromaticity for the four operational state of the circuit of FIG. 2A, the four-sided polygon depicts the chromaticity area in which light outputs from the circuit of FIG. 2A can achieve. By adjusting the time that each operational state is active in the circuit of FIG. 2A within a duty cycle, each point within the four-sided polygon can be created. Since significant portions of the Planckian locus curve 300 are within the four-sided polygon as depicted in FIG. 3, with the appropriate calibration and setting of the time slots for each operational state, the circuit of FIG. 2A can replicate the color of a black body as the color temperature changes by following the Planckian locus curve 300. This allows the circuit of FIG. 2A to achieve a high CIE Color Rendering Index (CRI) rating in specific applications. In one implementation in which a user can adjust color temperature of the lighting apparatus, the time slots selected for each operational state of the circuit of FIG. 2A can be adjusted to maintain the overall light output to follow the Planckian locus curve 300 as the user adjusts the desired color temperature.

Figure 2B:
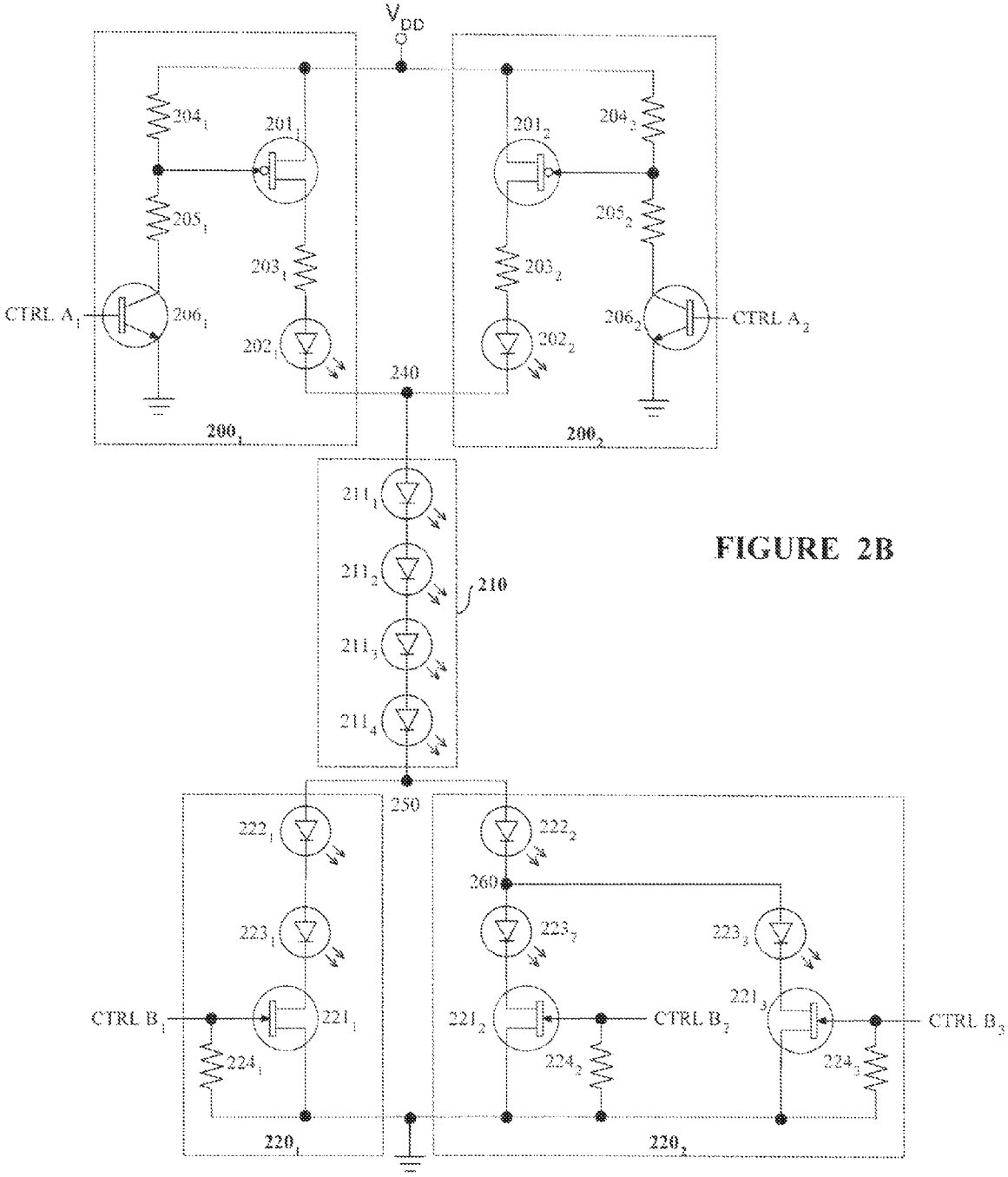

FIG. 2B is an electrical circuit diagram of a light engine according to a second embodiment of the present invention. The light engine of FIG. 2B is a modified light engine to the light engine described above with reference to FIG. 2A. Within FIG. 2B, the fourth parallel circuit $\mathbf{220}_2$ has been modified and further comprises an additional n-channel switching transistor $\mathbf{221}_3$ and an additional second LED $\mathbf{223}_3$. In this embodiment, the source of the additional n-channel transistor $\mathbf{221}_3$ is coupled to the ground rail and the additional second LED $\mathbf{223}_3$ is coupled between the drain of the additional n-channel transistor $\mathbf{221}_3$ and a node 260 between the first LED $\mathbf{222}_2$ and the second LED $\mathbf{223}_2$. The fourth parallel circuit $\mathbf{220}_2$ further comprises an additional pull-down resistor $\mathbf{224}_3$ coupled between the gate of the additional n-channel transistor $\mathbf{221}_3$ and the ground rail. The gate of the additional n-channel transistor $\mathbf{221}_1$ is further coupled to a corresponding control signal CTRL $B_3$.

In the circuit of FIG. 2B, the fourth parallel circuit $\mathbf{220}_2$ has been effectively divided into first and second parallel sub-circuits and a common sub-circuit. In this case, the first parallel sub-circuit comprises the n-channel transistor $\mathbf{221}_2$ coupled in series with the second LED $\mathbf{223}_2$ while the second parallel sub-circuit comprises the additional n-channel transistor $\mathbf{221}_3$ coupled in series with the additional second LED $\mathbf{223}_3$. The common sub-circuit comprises the first LED $\mathbf{222}_2$ and the node 260 comprises a common sub-node. In this architecture, there are three options for current paths among the n-channel transistors $\mathbf{221}_1$, $\mathbf{221}_2$, $\mathbf{221}_3$, a first potential current path via LEDs $\mathbf{222}_1$ and LED $\mathbf{223}_1$, a second potential current path via LED $\mathbf{222}_2$ and LED $\mathbf{223}_2$ and a third potential current path via LED $\mathbf{222}_2$ and LED $\mathbf{223}_3$. These additional potential current paths allow the circuit to operate within six active operational states rather than the four of the circuit of FIG. 2B. The following Table 3 summarizes these operational states.

TABLE 3

| | Operational States | | | | | | |
|---|---|---|---|---|---|---|---|
| | 1 | 2 | 3 | 4 | 5 | 6 | Inactive |
| Transistor $201_1$ | ON | OFF | ON | OFF | ON | OFF | OFF |
| Transistor $201_2$ | OFF | ON | OFF | ON | OFF | ON | OFF |
| Transistor $221_1$ | ON | ON | OFF | OFF | OFF | OFF | OFF |
| Transistor $221_2$ | OFF | OFF | ON | ON | OFF | OFF | OFF |
| Transistor $221_3$ | OFF | OFF | OFF | OFF | ON | ON | OFF |
| LED $202_1$ | ON | OFF | ON | OFF | ON | OFF | OFF |
| LED $202_2$ | OFF | ON | OFF | ON | OFF | ON | OFF |
| LED $211_1$ | ON | ON | ON | ON | ON | ON | OFF |
| LED $211_2$ | ON | ON | ON | ON | ON | ON | OFF |
| LED $211_3$ | ON | ON | ON | ON | ON | ON | OFF |
| LED $211_4$ | ON | ON | ON | ON | ON | ON | OFF |
| LED $222_1$ | ON | ON | OFF | OFF | OFF | OFF | OFF |
| LED $223_1$ | ON | ON | OFF | OFF | OFF | OFF | OFF |
| LED $222_2$ | OFF | OFF | ON | ON | ON | ON | OFF |
| LED $223_2$ | OFF | OFF | ON | ON | OFF | OFF | OFF |
| LED $223_3$ | OFF | OFF | OFF | OFF | ON | ON | OFF |
| Total LEDs ON | 7 | 7 | 7 | 7 | 7 | 7 | 0 |

Using the circuit of FIG. 2B, additional flexibility in terms of output light spectrums can be achieved as the difference between the light aspects of LED $\mathbf{223}_2$ and LED $\mathbf{223}_3$ provide additional nodes within the chromaticity diagram of FIG. 3. Within FIG. 3, the six operational states of the circuit of FIG. 2B can be depicted as a polygon within the CIE chromaticity diagram coupling the convex boundary nodes together. This polygon may comprise a six-sided polygon if all six nodes are convex boundary nodes in the chromaticity diagram, though if one or more of the nodes are internal to a larger polygon, the polygon may be five or four sided. In this case, by selecting time slots within the duty cycle for the six operational states to be active, a controller can enable the lighting apparatus to produce light outputs with chromaticity within the polygon.

Figure 4A:
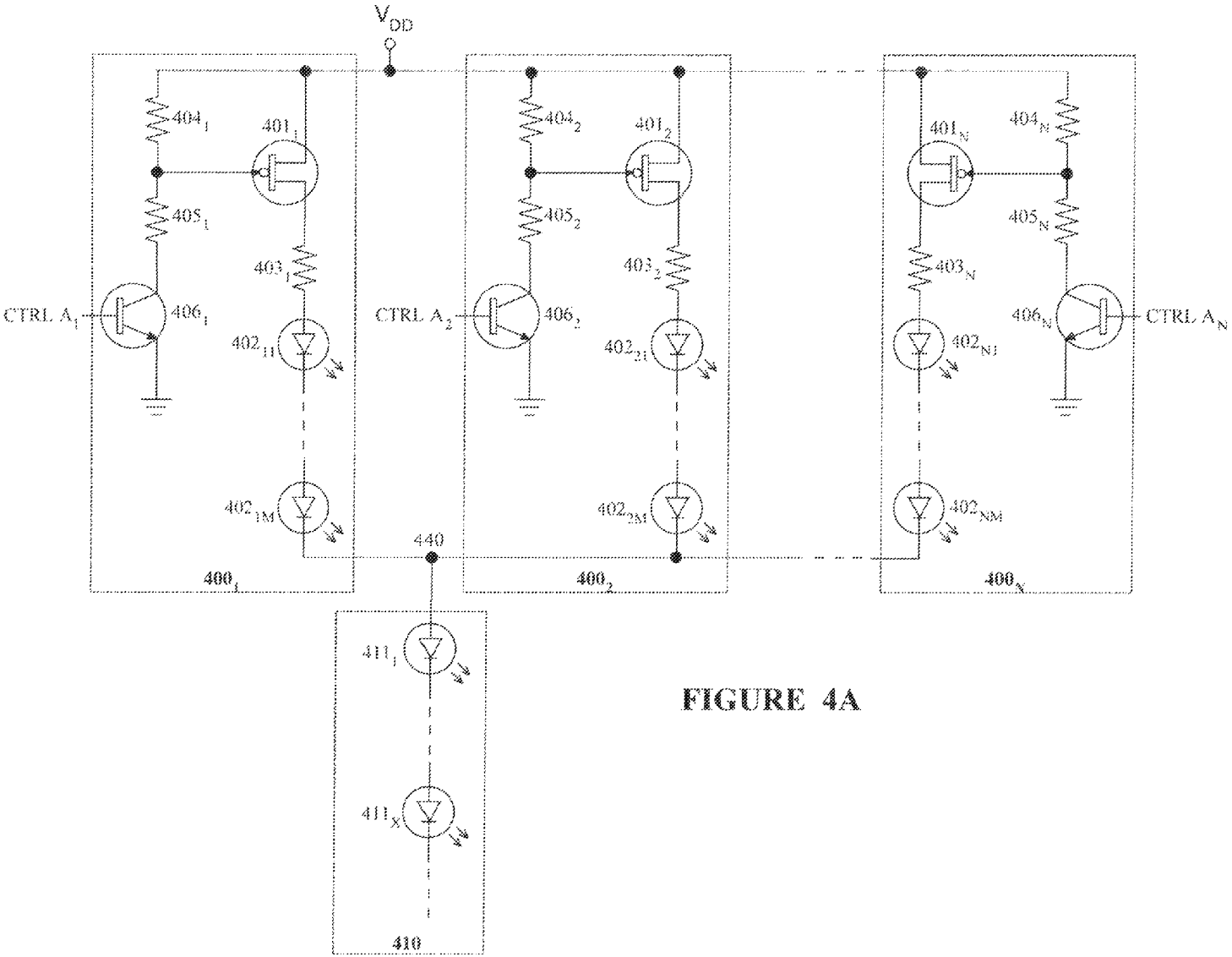
FIGS. 4A, 4B, 5A and 5B are electrical circuit diagrams of portions of LED light engines according to alternative embodiments of the present invention.
Figure 4B:
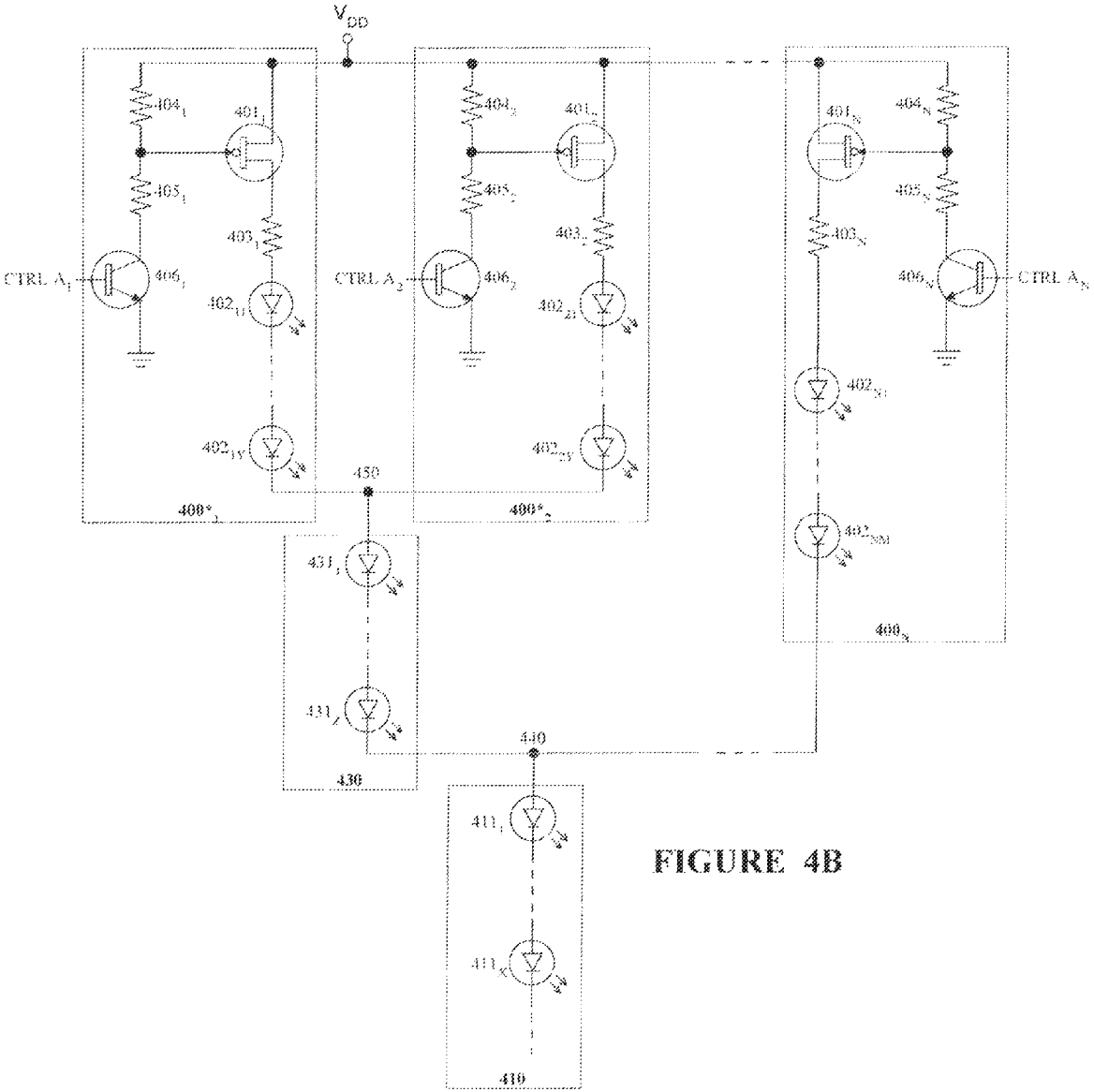
Figure 5A:
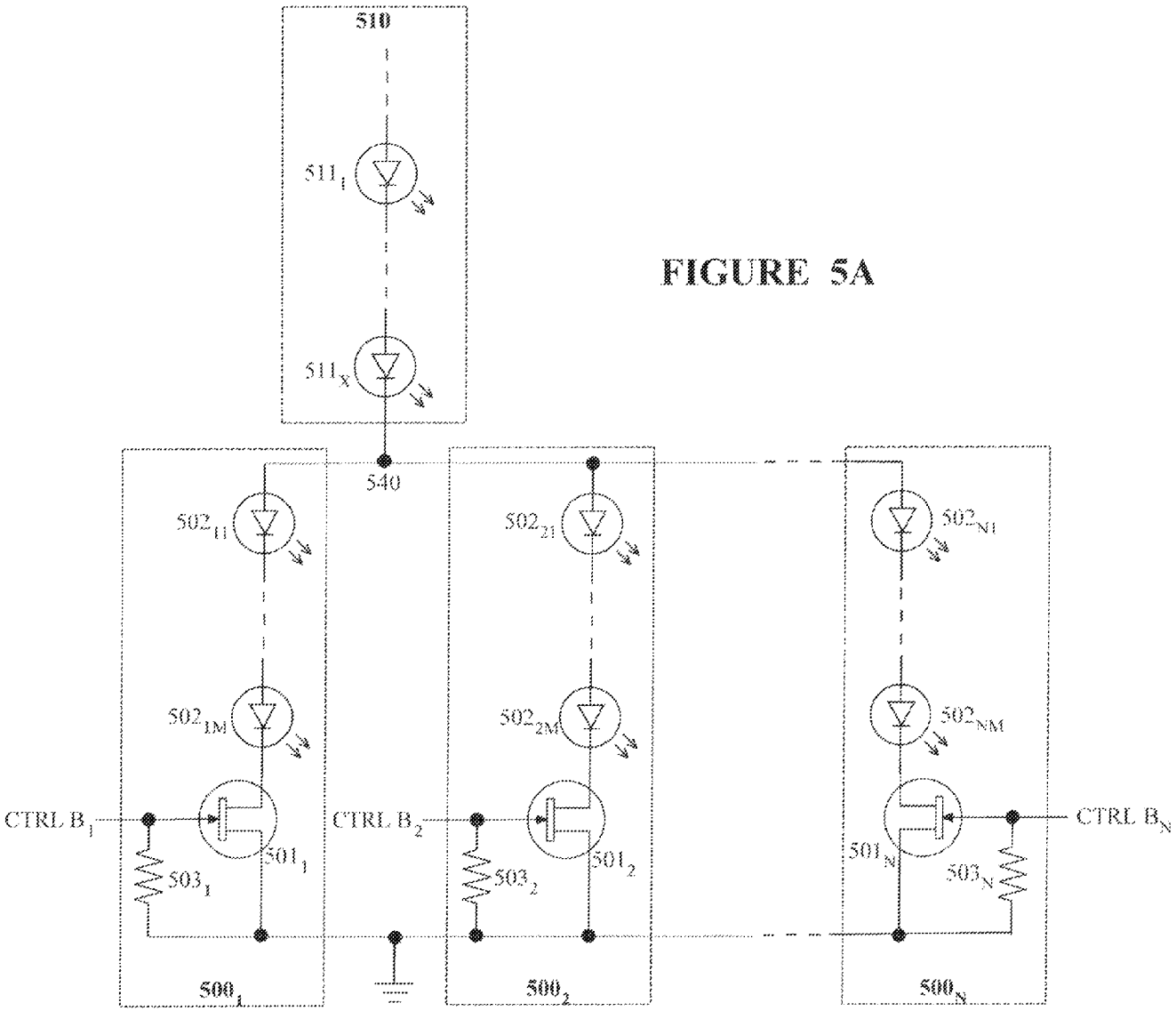
Figure 5B:
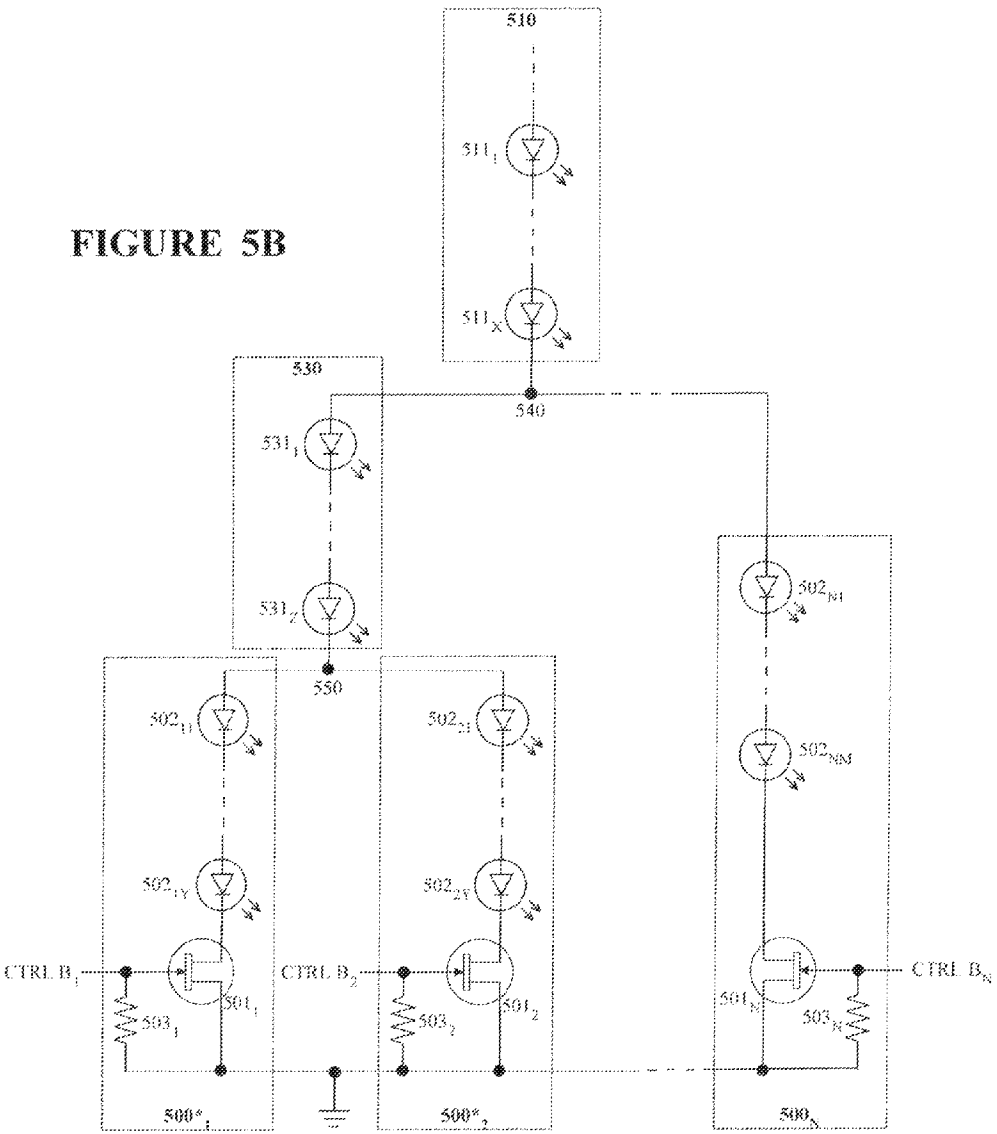

FIGS. 4A, 4B, 5A and 5B are electrical circuit diagrams of portions of LED light engines according to alternative embodiments of the present invention. These Figures are more generic embodiments to the specific sample implementations illustrated in FIGS. 2A and 2B. FIGS. 4A and 4B depict light engine circuits comprising parallel circuits that are coupled to the power rail while FIGS. 5A and 5B depict light engine circuits comprising parallel circuits that are coupled to the ground rail.

The light engine of FIG. 4A comprises a plurality of parallel circuits $\mathbf{400}_1,\mathbf{400}_2,\mathbf{400}_N$ and a common circuit 410 coupled together at a common node 440, N being an integer that defines the number of parallel circuits. Each of the parallel circuits $\mathbf{400}_1,\mathbf{400}_2,\mathbf{400}_N$ comprises a respective p-channel switching transistor $\mathbf{401}_1,\mathbf{401}_2,\mathbf{401}_N$ coupled in series with a resistor $\mathbf{403}_1,\mathbf{403}_2,\mathbf{403}_N$ and one or more LEDs $\mathbf{402}_{11}$-$\mathbf{402}_{1M}$, $\mathbf{402}_{21}$-$\mathbf{402}_{2M}$, $\mathbf{402}_{N1}$-$\mathbf{402}_{NM}$ respectively; M being an integer and defining the number of LEDs within a single parallel circuit. The sources of the p-channel transistors $\mathbf{401}_1$, $\mathbf{401}_2,\mathbf{401}_N$ are all coupled to the power rail ($V_{DD}$) while the drains of the p-channel transistors $\mathbf{401}_1,\mathbf{401}_2,\mathbf{401}_N$ are coupled to one end of the respective resistors $\mathbf{403}_1,\mathbf{403}_2,\mathbf{403}_N$. The LEDs $\mathbf{402}_{11}$-$\mathbf{402}_{1M}$, $\mathbf{402}_{21}$-$\mathbf{402}_{2M}$, $\mathbf{402}_{N1}$-$\mathbf{402}_{NM}$ are coupled between the other end of the respective resistors $\mathbf{403}_1,\mathbf{403}_2,\mathbf{403}_N$ and the common node 440. As shown in FIG. 4A, each of the parallel circuits $\mathbf{400}_1,\mathbf{400}_2,\mathbf{400}_N$ each further comprise a pull-up resistor $\mathbf{404}_1,\mathbf{404}_2,\mathbf{404}_N$ respectively coupled between the gate of the corresponding p-channel transistor $\mathbf{401}_1,\mathbf{401}_2,\mathbf{401}_N$ and the power rail ($V_{DD}$); and a pull-down resistor $\mathbf{405}_1,\mathbf{405}_2,\mathbf{405}_N$ respectively coupled in series with a corresponding NPN bipolar transistor $\mathbf{406}_1$, $\mathbf{406}_2,\mathbf{406}_N$. The pull-down resistors $\mathbf{405}_1,\mathbf{405}_2,\mathbf{405}_N$ are coupled between the gate of the respective p-channel transistors $\mathbf{401}_1,\mathbf{401}_2,\mathbf{401}_N$ and the collector of the respective NPN bipolar transistor $\mathbf{406}_1,\mathbf{406}_2,\mathbf{406}_N$ while the emitters of the NPN bipolar transistors $\mathbf{406}_1,\mathbf{406}_2,\mathbf{406}_N$ are coupled to the ground rail. The base of each of the NPN bipolar transistors $\mathbf{406}_1,\mathbf{406}_2,\mathbf{406}_N$ are coupled to a corresponding control signal CTRL $A_1$, CTRL $A_2$, CTRL $A_N$.

The common circuit 410, within the embodiment depicted in FIG. 4A, comprises one or more LEDs $\mathbf{411}_1$-$\mathbf{411}_X$ coupled in series between the common node 440 and the ground rail (not shown); X being an integer that defines the number of LEDs within the common circuit 410. In this particular embodiment, the one or more LEDs $\mathbf{411}_1$-$\mathbf{411}_X$ are common to all potential current paths and therefore will be activated whenever any of the potential current paths are activated. In some embodiments of the present invention, the common circuit 410 is coupled directly to the ground rail and there are no additional parallel circuits between the common circuit 410 and the ground rail. In these cases, the number of independent parallel circuits $\mathbf{400}_1,\mathbf{400}_2,\mathbf{400}_N$ solely define the number of operational states for the circuit and therefore, in this embodiment, there are N active operational states for the circuit. In other embodiments, there may be additional parallel circuits implemented between the common circuit 410 and the ground rail, such as those described below with reference to FIGS. 5A and 5B. In these cases, the number of operational states for the circuit will be defined by multiplying the number of independent parallel circuits between the common circuit and the power rail with the number of independent parallel circuits between the common circuit and the ground rail. This may be achieved in some cases by multiplying the number of p-channel switching transistors in the circuit by the number of n-channel switching transistors in the circuit.

The light engine of FIG. 4B is a modified light engine to the light engine described above with reference to FIG. 4A. Within FIG. 4B, a plurality of parallel circuits $\mathbf{400*}_1,\mathbf{400*}_2$ are coupled to a common sub-circuit 430 at a common sub-node 450. In this embodiment, the parallel circuits $\mathbf{400*}_1$, $\mathbf{400*}_2$ are identical to the parallel circuits $\mathbf{400}_1$, $\mathbf{400}_2$ of FIG. 4A but rather than M LEDs, the parallel circuits $\mathbf{400*}_1$, $\mathbf{400*}_2$ each comprise Y LEDs, Y being an integer less than M. The common sub-circuit 430 comprises one or more LEDs $\mathbf{431}_1$-$\mathbf{431}_Z$ coupled in series between the common sub-node 450 and the common node 440; Z being an integer that defines the number of LEDs within the common sub-circuit 430. In some embodiments, in order to maintain similar loads on the various parallel circuits that are coupled between the power rail and the common node 440, the sum of X and Y is equal to M. Therefore, in these embodiments, irrespective of which parallel circuit is activated, the same number of LEDs is utilized and therefore relatively similar loads are applied to the power supply. In some embodiments, adjusting the impedances of the resistors $\mathbf{403}_1,\mathbf{403}_2,\mathbf{403}_N$ is done to further improve the balance of the plurality of parallel circuits $\mathbf{400}_1,\mathbf{400}_2,\mathbf{400}_N$.

The light engine of FIG. 5A comprises a plurality of parallel circuits $\mathbf{500}_1,\mathbf{500}_2,\mathbf{500}_N$ and a common circuit 510 coupled together at a common node 540, N being an integer that defines the number of parallel circuits. Each of the parallel circuits $\mathbf{500}_1,\mathbf{500}_2,\mathbf{500}_N$ comprises a respective n-channel switching transistor $\mathbf{501}_1,\mathbf{501}_2,\mathbf{501}_N$ coupled in series with one or more LEDs $\mathbf{502}_{11}$-$\mathbf{502}_{1M}$, $\mathbf{502}_{21}$-$\mathbf{502}_{2M}$, $\mathbf{502}_{N1}$-$\mathbf{502}_{NM}$ respectively; M being an integer and defining the number of LEDs within a single parallel circuit. The sources of the n-channel transistors $\mathbf{501}_1,\mathbf{501}_2,\mathbf{501}_N$ are all coupled to the ground rail while the LEDs $\mathbf{502}_{11}$-$\mathbf{502}_{1M}$, $\mathbf{502}_{21}$-$\mathbf{502}_{2M}$, $\mathbf{502}_{N1}$-$\mathbf{502}_{NM}$ are coupled between the drains of the respective n-channel transistors $\mathbf{501}_1,\mathbf{501}_2,\mathbf{501}_N$ and the common node 540. Each of the parallel circuits $\mathbf{500}_1,\mathbf{500}_2,\mathbf{500}_N$ further comprise a pull-down resistor $\mathbf{504}_1,\mathbf{504}_2,\mathbf{504}_N$ respectively coupled between the gate of the corresponding n-channel transistor $\mathbf{501}_1,\mathbf{501}_2,\mathbf{501}_N$ and the ground rail. The gate of each of the n-channel transistors $\mathbf{501}_1,\mathbf{501}_2,\mathbf{501}_N$ are further coupled to a corresponding control signal CTRL $B_1$, CTRL $B_2$, CTRL $B_N$.

The common circuit 510, within the embodiment depicted in FIG. 5A, comprises one or more LEDs $\mathbf{511}_1$-$\mathbf{511}_X$ coupled in series between the common node 540 and the power rail (not shown); X being an integer that defines the number of LEDs within the common circuit 510. In this particular embodiment, the one or more LEDs $\mathbf{511}_1$-$\mathbf{511}_X$ are common to all potential current paths and therefore will be activated whenever any of the potential current paths are activated. In some embodiments of the present invention, the common circuit 510 is coupled directly to the power rail and there are no additional parallel circuits between the common circuit 510 and the power rail. In these cases, the number of independent parallel circuits $\mathbf{500}_1,\mathbf{500}_2,\mathbf{500}_N$ solely define the number of operational states for the circuit and therefore, in this embodiment, there are N active operational states for the circuit. In other embodiments, there may be additional parallel circuits implemented between the common circuit 510 and the power rail, such as those described above with reference to FIGS. 4A and 4B. In these cases, the number of operational states for the circuit will be defined by multiplying the number of independent parallel circuits between the common circuit and the power rail with the number of independent parallel circuits between the common circuit and the ground rail. This may be achieved in some cases by multiplying the number of p-channel switching transistors in the circuit by the number of n-channel switching transistors in the circuit.

The light engine of FIG. 5B is a modified light engine to the light engine described above with reference to FIG. 5A.

Within FIG. 5B, a plurality of parallel circuits 500*$_1$,500*$_2$ are coupled to a common sub-circuit 530 at a common sub-node 550. In this embodiment, the parallel circuits 500*$_1$, 500*$_2$ are identical to the parallel circuits 500$_1$, 500$_2$ of FIG. 5A but rather than M LEDs, the parallel circuits 500*$_1$, 500*$_2$ each comprise Y LEDs, Y being an integer less than M. The common sub-circuit 530 comprises one or more LEDs 531$_1$-531$_Z$ coupled in series between the common sub-node 550 and the common node 540; Z being an integer that defines the number of LEDs within the common sub-circuit 530. In some embodiments, in order to maintain similar loads on the various parallel circuits that are coupled between the ground rail and the common node 540, the sum of X and Y is equal to M. Therefore, in these embodiments, irrespective of which parallel circuit is activated, the same number of LEDs is utilized and therefore relatively similar loads are applied to the power supply. In some embodiments, adjusting adding resistors in parallel with the LEDs 502$_{11}$-502$_{1M}$, 502$_{21}$-502$_{2M}$, 502$_{N1}$-502$_{NM}$ is done to further improve the balance of the plurality of parallel circuits 500$_1$,500$_2$,500$_N$.

As described above, within some embodiments of the present invention, the parallel circuits are load balanced such that irrespective of the operational state, the load of the overall circuit remains relatively similar. As described, this load balancing can be enabled by selecting the same number of LEDs for each parallel circuit that are coupled between the power rail and the common circuit and by selecting the same number of LEDs for each parallel circuit that are coupled between the ground rail and the common circuit. This load balancing can be further enhanced by applying impedances in series with the LEDs to match the load across parallel circuits, especially in the case that the LEDs in different parallel circuits have different voltage drops for equal current. In other embodiments, load balancing is achieved across the entire circuit by matching a pair of parallel circuits within each active operational state, one parallel circuit coupled between the power rail and the common circuit and one parallel circuit coupled between the ground rail and the common circuit. In these embodiments, a select set of operational states are defined that have relatively balanced loads. In these cases, resistors could additionally be used to further enhance the balance.

Although the present invention is described herein above with the use of a constant voltage power supply, it should be understood that circuits similar to those described above may be implemented with constant current power supply architectures. In this case, the power rail and the ground rail would be replaced with a variable voltage rail and a current sense rail (typically close to ground) respectively. The voltage on the voltage rail is variable to compensate for changes in load, hence maintaining the current at the prescribed level. In these embodiments, load balancing across parallel circuits are less necessary since the constant current power supply will compensate for changes in the load. For instance, using a constant current power supply would allow the use of different numbers of LEDs within the various parallel circuits, thus potentially increasing the variability between the plurality of active operational states. In particular, this could allow for significant changes in intensity to be achieved within different active operational states.

In some embodiments of the present invention, a user of the lighting apparatus may adjust both the intensity and the light spectrum wavelengths of the light output. In these embodiments, the intensity of the light can be controlled using the inactive operational state in which no LEDs are operational in order to dim the lighting apparatus. To accomplish the desired intensity and light spectrum, the controller can first determine the amount of time (ex. number of time slots) that the lighting apparatus needs to be in the inactive operational state within the duty cycle and then proportionally divide up the remaining time (ex. remaining time slots) within the duty cycle between the plurality of active operational states to generate the desired light spectrum. In some embodiments, compensation for low lumen wavelengths of light (ex. red) may need to be made such that the light output is of the intensity expected by the user. For instance, in some embodiments, the amount of time (ex. number of time slots) within the duty cycle assigned to the inactive operational state may be reduced if the desired light spectrum is focused primarily upon wavelengths of light that have lower lumens per LED.

Although the embodiments of the present invention described above are focused on LEDs with limited wavelength bands, it should be understood that this is not meant to limit the scope of the present invention. In some embodiments of the present invention, LEDs with broad wavelength bands are utilized such as white LEDs that output a broad spectrum of light wavelengths or integrated LED modules that comprise a plurality of LEDs that output different wavelengths of light. Examples of integrated LED modules include RGB and RGBA LED modules that comprise red/green/blue LEDs and red/green/blue/amber LEDs respectively. The white LEDs or integrated LED modules used within embodiments of the present invention may be focused on a particular color temperature of white light. The use of a plurality of such LEDs with a plurality of different color temperatures can allow for changes in the wavelength spectrum of the light output for the lighting apparatus. In some embodiments, only white LEDs of varying color temperature are implemented within the parallel circuits to achieve the desired dynamic light output.

The embodiments of the present invention described above focused on the variable wavelengths that the LEDs used in the parallel circuits and common circuits may have. In alternative embodiments, the operational states within the circuit according to the present invention control the intensity of the light output from the lighting apparatus using the active operational states for the circuit. In these embodiments, LEDs of varying intensity levels are implemented within the parallel circuits. Thus, by selecting the amount of time (ex. number of time slots) within the duty cycle for each of the operational states, the overall intensity of the output light can be controlled. It should be understood that the intensity control could further be implemented along with color and/or color temperature control.

Although described as time slots within a duty cycle, it should be understood that the divisions within a duty cycle may be in any segments. For instance, in some embodiments of the present invention, the duty cycle is divided into time segments in p seconds. In other embodiments, the duty cycle is divided into time slots (ex. 256) but the actual number of time slots assigned to a particular operational state may not be an integer. In these cases, the exact selection of the number of time slots may be set by an average of the number of time slots across a plurality of duty cycles.

Although various embodiments of the present invention have been described and illustrated, it will be apparent to those skilled in the art that numerous modifications and variations can be made without departing from the scope of the invention, which is defined in the appended claims.

What is claimed is:

1. A lighting apparatus comprising:

a plurality of parallel circuits, each parallel circuit comprising a switching element and one or more light emitting diodes coupled in series between a common node and one of a power rail and a ground rail; and a common circuit comprising one or more light emitting diodes coupled in series between the common node and the other one of the power rail and the ground rail.

2. The lighting apparatus according to claim 1, wherein the switching elements in the plurality of parallel circuits are controlled by a plurality of respective control signals, said control signals activating the plurality of switching elements at different times during a duty cycle such that significant current flows through only one of the parallel circuits at one time.

3. The lighting apparatus according to claim 1, wherein at least one of the plurality of parallel circuits comprise a plurality of parallel sub-circuits and a common sub-circuit; each of the parallel sub-circuits comprising a switching element and one or more light emitting diodes coupled in series between a common sub-node and the one of the power rail and the ground rail; the common sub-circuit comprising one or more light emitting diodes coupled in series between the common sub-node and the common node.

4. The lighting apparatus according to claim 1, wherein each of the plurality of parallel circuits are substantially balanced such that there is a similar voltage drop across each of the parallel circuits.

5. The lighting apparatus according to claim 4, wherein each of the plurality of parallel circuits further comprise a resistor coupled in series with the switching element and the one or more light emitting diodes, impedances of the resistors within the plurality of parallel circuits being set to substantially balance the parallel circuits such that there is a similar voltage drop across each of the parallel circuits.

6. The lighting apparatus according to claim 1, wherein the one or more light emitting diodes within each of the parallel circuits are equal in number.

7. The lighting apparatus according to claim 6, wherein a voltage on the power rail is within an acceptable voltage range for voltage drops across a sum of light emitting diodes within any one of the parallel circuits and within the common circuit.

8. The lighting apparatus according to claim 1, wherein the plurality of parallel circuits comprise a plurality of first parallel circuits and the common node comprises a first common node; wherein the switching element and the one or more light emitting diodes within each of the first parallel circuits are coupled in series between the power rail and the first common node; wherein the lighting apparatus further comprises a plurality of second parallel circuits, each of the second parallel circuits comprising a switching element and one or more light emitting diodes coupled in series between a second common node and the ground rail; wherein the light emitting diodes in the common circuit are coupled in series between the first and second common nodes.

9. The lighting apparatus according to claim 1, wherein the one or more light emitting diodes within the common circuit comprise light emitting diodes that output wavelengths of light in a middle spectrum band within an overall light spectrum band visible to humans.

10. The lighting apparatus according to claim 9, wherein the one or more light emitting diodes within at least one of the parallel circuits comprise one or more light emitting diodes that output wavelengths of light outside of the middle spectrum band.

11. The lighting apparatus according to claim 10, wherein the one or more light emitting diodes within at least one of the parallel circuits comprise one or more light emitting diodes that output wavelengths of light greater than the middle spectrum band and the one or more light emitting diodes within at least one other of the parallel circuits comprise one or more light emitting diodes that output wavelengths of light less than the middle spectrum band.

12. The lighting apparatus according to claim 1, wherein the one or more light emitting diodes within the common circuit comprise one or more light emitting diodes that output wavelengths of light in a broad spectrum band.

13. The lighting apparatus according to claim 12, wherein the one or more light emitting diodes within at least one of the parallel circuits comprise one or more light emitting diodes that output wavelengths of light in a narrow spectrum band.

14. The lighting apparatus according to claim 12, wherein the one or more light emitting diodes that output wavelengths of light in a broad spectrum band comprise one of white light emitting diodes and integrated light emitting diodes that comprise a plurality of light emitting diodes that output different wavelengths of light.

15. The lighting apparatus according to claim 1, wherein each of the switching elements within the plurality of parallel circuits comprises a p-channel switching transistor, the p-channel switching transistor and the one or more light emitting diodes within each of the parallel circuits being coupled in series between the power rail and the common node; and wherein the one or more light emitting diodes within the common circuit are coupled in series between the common node and the ground rail.

16. The lighting apparatus according to claim 14, wherein the plurality of parallel circuits comprise a plurality of first parallel circuits and the common node comprises a first common node; wherein the lighting apparatus further comprises a plurality of second parallel circuits, each of the second parallel circuits comprising an n-channel switching transistor and one or more light emitting diodes coupled in series between a second common node and the ground rail; wherein the light emitting diodes in the common circuit are coupled in series between the first and second common nodes.

17. The lighting apparatus according to claim 1, wherein each of the switching elements within the plurality of parallel circuits comprises an n-channel switching transistor, the n-channel switching transistor and the one or more light emitting diodes within each of the parallel circuits being coupled in series between the ground rail and the common node; and wherein the one or more light emitting diodes within the common circuit are coupled in series between the common node and the power rail.

18. The lighting apparatus according to claim 1 further comprising a controller operable to control the switching elements within each of the parallel circuits, the controller operable to turn on the switching elements within the parallel circuits at different times during a duty cycle such that significant current flows through only one of the parallel circuits at one time.

19. The lighting apparatus according to claim 1 further comprising an optics element that diffuses light output by the one or more light emitting diodes within the parallel circuits and the common circuit such that a single color of light is perceivable at an output of the lighting apparatus.

20. A lighting apparatus comprising:

a first circuit comprising a first transistor and one or more first light emitting diodes, a source of the first transistor being coupled to one of a power rail and a ground rail and a gate of the first transistor operable to receive a first control signal to activate the first transistor; the one or more first light emitting diodes being coupled in series between a drain of the first transistor and a common node;

a second circuit comprising a second transistor and one or more second light emitting diodes, a source of the second transistor being coupled to the one of the power rail and the ground rail and a gate of the second transistor operable to receive a second control signal to activate the second transistor; the one or more second light emitting diodes being coupled in series between a drain of the second transistor and the common node; and a third circuit comprising one or more third light emitting diodes coupled in series between the common node and the other one of the power rail and the ground rail.

* * * * *